US005863243A

United States Patent [19]

Ali

[11] Patent Number: 5,863,243

[45] Date of Patent: Jan. 26, 1999

[54] SANDING BLOCK

[76] Inventor: Frank Ali, 611 Yellow Springs-Fairfield Rd., Fairborn, Ohio 45324

[21] Appl. No.: 900,098

[22] Filed: Jul. 25, 1997

[51] Int. Cl.[6] ..... B24D 15/04

[52] U.S. Cl. ..... 451/503; 451/523

[58] Field of Search ..... 451/502, 503, 451/514, 523, 524

[56] References Cited

U.S. PATENT DOCUMENTS

| | | | |
|---|---|---|---|
| 1,599,906 | 9/1926 | McKnight | 451/503 |
| 2,765,593 | 9/1956 | Salmon et al. | 451/518 |
| 4,221,084 | 9/1980 | Frantzen | 451/503 |

OTHER PUBLICATIONS

3M Paint Dept. Products 1996.
Norton –"Rough and Ready".
Norton "True Grit".

*Primary Examiner*—Robert A. Rose
*Assistant Examiner*—Dung Van Nguyen
*Attorney, Agent, or Firm*—R. William Graham

[57] ABSTRACT

A sanding block has a first member having an intermediate portion and a pair of relatively flexible ends wherein a top surface of the first member is configured to be hand held and a bottom surface of each of the ends has at least one retention open surface therein and a second relatively rigid member having an intermediate portion connected to the intermediate portion of the first member and a pair of ends wherein a top surface of each end of the second member has extending therefrom at least one complimentary retention protrusion which respectively seat in one of the retention open surfaces and wherein the ends of the second member have a chamfered edge extending about a periphery of the top surface of each end of the second member.

10 Claims, 4 Drawing Sheets

SANDING BLOCK

BACKGROUND OF THE INVENTION

1. Field of the Invention

The invention relates generally to the field of sanding devices. More particularly, but not by way of limitation, the present invention relates to improvements in sanding blocks.

2. Related Art

There presently exists a variety of styles of sanding blocks. These sanding blocks are generally integrally formed of rubber and typically include a first member having an intermediate portion and a pair of ends wherein a top surface of the first member is configured to be hand held and a bottom surface of each of the ends has retention surfaces therein and a second member having an intermediate portion connected to the intermediate portion of the first member and a pair of ends wherein a top surface of each end of the second member has a plurality of nails complimentary formed to respectively seat in one of the retention open surfaces. The respective first ends must be pried apart such that the nails are removed from the retention surfaces so that an end of a piece of sandpaper can be disposed between the first ends whereupon release of the ends the nails pierces the sandpaper to hold the same in place. The second ends are likewise manipulated to retain the other end of the sandpaper.

Present sanding blocks have not, however, evolved to meet the needs of the user. For instance, it is desirable to minimize fatigue to the user while maintaining the effectiveness of the sanding block. Such sanding blocks are presently formed with a smooth surface. Also, the rubber material employed in these blocks is relatively rigid, dense and heavy and difficult for the user to pry apart. This is particularly true for woman which are increasingly entering into the do-it-yourself (DYI) market. Also, women find it difficult to use the present sanding block without breaking their finger nails.

The present invention overcomes these deficiencies of present sanding blocks. The present invention also meets the needs of present day consumer.

BRIEF SUMMARY OF THE INVENTION

It is an object to improve sanding blocks.

It is another object to enhance the ease of use of sanding blocks while maintaining effectiveness of the same.

Accordingly, the present invention is directed to a sanding block having a first member having an intermediate portion and a pair of relatively flexible ends wherein a top surface of the first member is configured to be hand held and a bottom surface of each of the ends has at least one retention open surface therein and a second relatively rigid member having an intermediate portion connected to the intermediate portion of the first member and a pair of ends wherein a top surface of each end of the second member has extending therefrom at least one complimentary retention protrusion which respectively seat in one of the retention open surfaces and wherein the ends of the second member have a chamfered edge extending about a periphery of the top surface of each end of the second member. The top surface of the first member has a plurality of relatively flexible treads formed thereon which aid the user in gripping the sanding block. A bottom surface of the second member has a plurality of relatively nonflexible treads formed on the surface thereof to aid in not only gripping the back side of the sandpaper but also in its removal of sticky back sandpaper, for example.

Also, the retention protrusions are part of relatively rigid plastic plate immovably partially disposed within the second member.

Other objects and advantages will be readily apparent to those skilled in the art upon viewing the drawings and reading the detailed description hereafter.

DETAILED DESCRIPTION OF THE INVENTION

Figure 1:
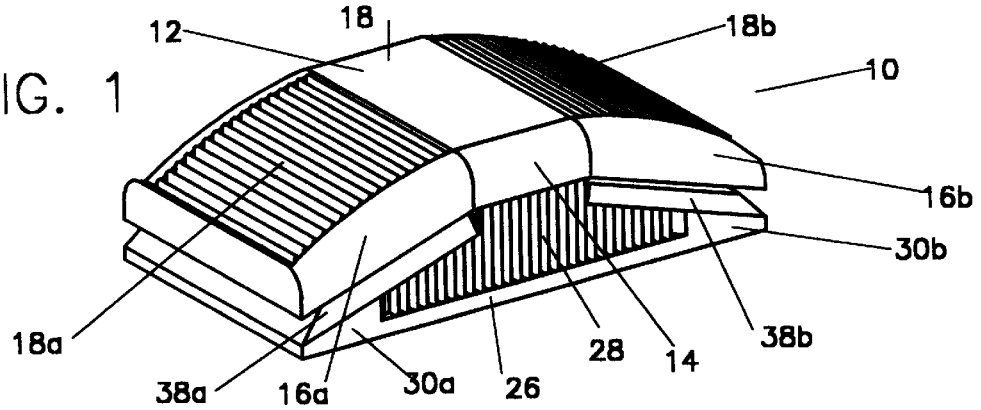
FIG. 1 is a perspective view of the present invention.
Figure 2:
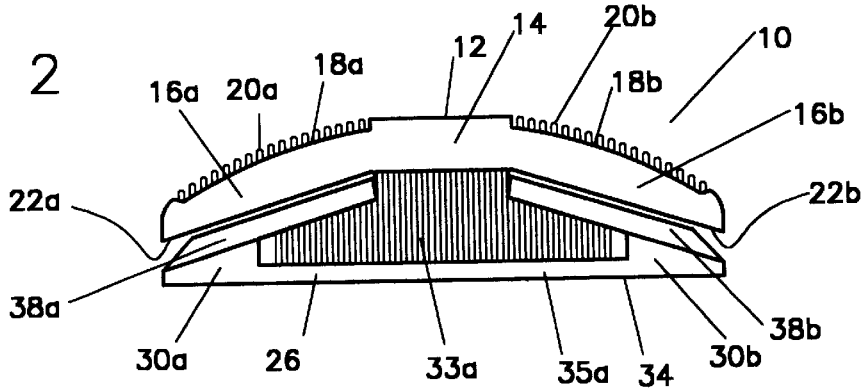
FIG. 2 is a side view of the present invention.
Figure 3:
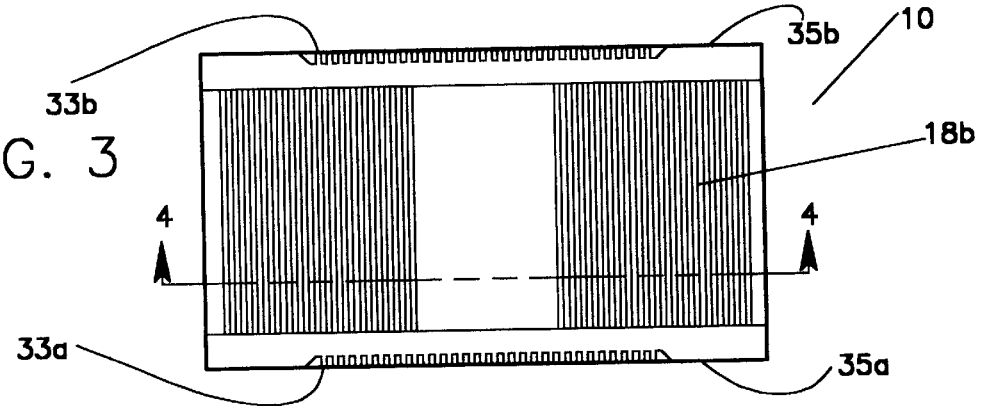
FIG. 3 is a top view of the present invention.
Figure 4:
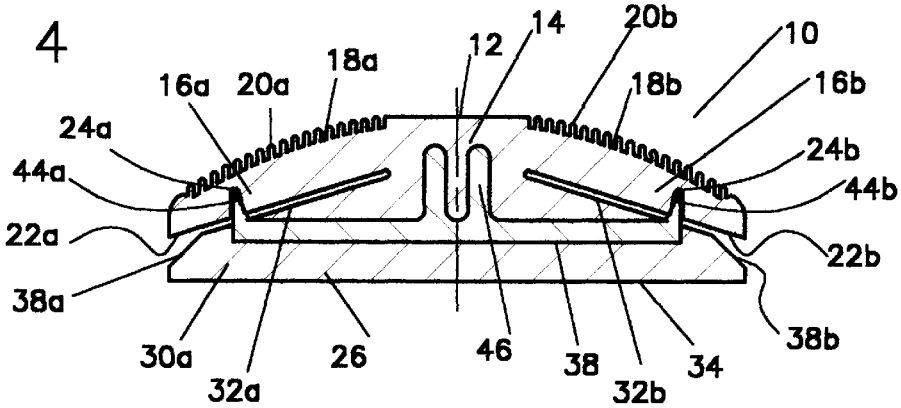
FIG. 4 is a cross-sectional view of the present invention taken through line 4—4.
Figure 5:
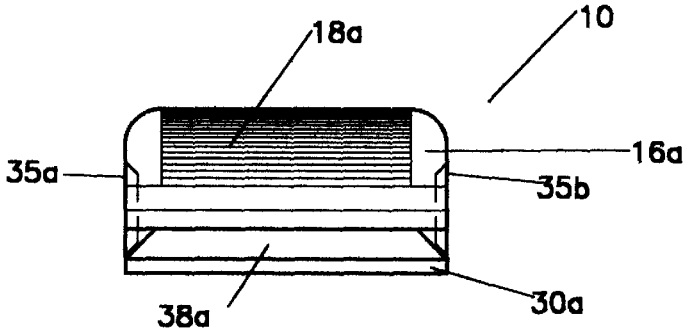
FIG. 5 is an end view of the present invention.
Figure 6:
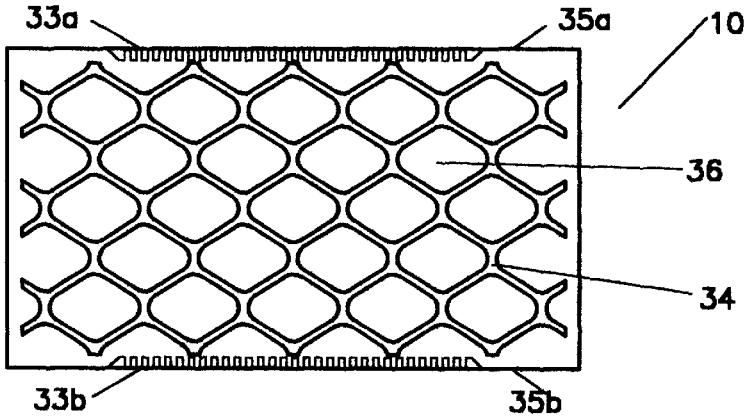
FIG. 6 is a bottom view of the present invention.

Referring now to the drawings in FIGS. 1–6, the sanding block of the present invention is generally referred to by the numeral 10. The sanding block 10 has a first member 12 which has an intermediate portion 14 and a pair of relatively flexible ends 16*a* and 16*b*. A top surface 18 of the first member 12 is configured to be hand held. In this regard, the top surface 18 of the first member 12 has surface portions 18*a* and 18*b* which have a plurality of relatively flexible treads 20*a* and 20*b*, respectively, formed transversely thereon. These treads 18*a* and 18*b* aid the user in gripping the sanding block. Bottom surfaces 22*a* and 22*b* of each of the ends 16*a* and 16*b*, respectively, each have a plurality of retention open surfaces 24*a* and 24*b*, respectively.

The sanding block 10 has a second member 26 having an intermediate portion 28 connected, preferably integrally, to the intermediate portion 14 of the first member 12. The second member 26 also has a pair of ends 30*a* and 30*b* which are disposed adjacent ends 16*a* and 16*b*, respectively, and are generally of about the same length. Each of the ends 30*a* and 30*b* have a top surface 32*a* and 32*b*, respectively, which face the bottom surfaces 22*a* and 22*b*, respectively.

Similarly, treads 33*a* and 33*b* are provided on side surfaces 35*a* and 35*b* of the second member 26 to aid the user in gripping the sanding block 10. The second member 26 has a bottom surface 34 best seen in FIG. 6 and has a plurality of relatively nonflexible treads 36 formed thereon to aid in not only gripping the back side of the sandpaper but also in its removal of sticky back sandpaper, for example.

Chamfered surface portions 38*a* and 38*b* extend along a periphery of top surfaces 32*a* and 32*b*, respectively. Here, the chamfered surface portions 38*a* and 38*b* are preferably chamfered at a sufficient slant to permit the bottom surfaces 22*a* and 22*b* to be gripped with a user's pad of a finger tip in a manner such that the user's finger nail is less likely to be damaged in prying apart the ends 16 from ends 30 in order to insert a piece of sandpaper therebetween.

The first member 12 and the second member 26 are preferably integrally formed via a molding process. The first member 12 and second member 26 are preferably made of a relatively flexible polyvinyl chloride rubber-like material. It is recognized that other relatively flexible materials may be employed to accomplish the purposes described herein.

Figure 7:
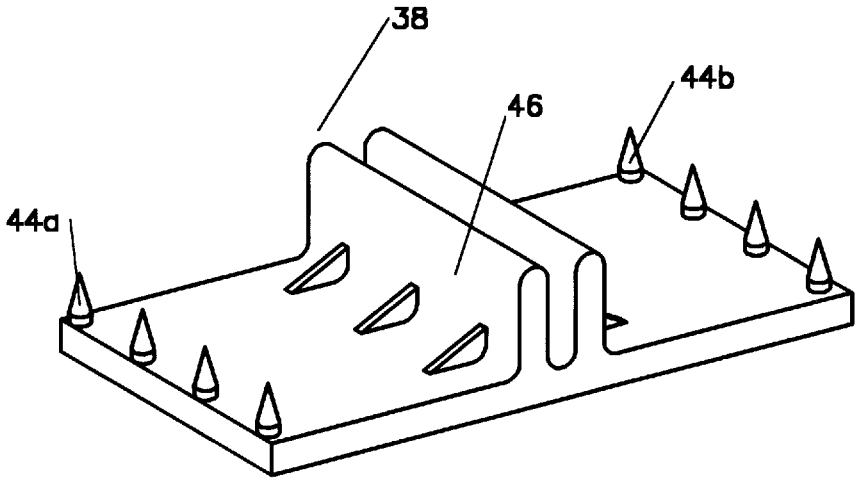
FIG. 7 is a perspective view of a part the present invention.
Figure 8:
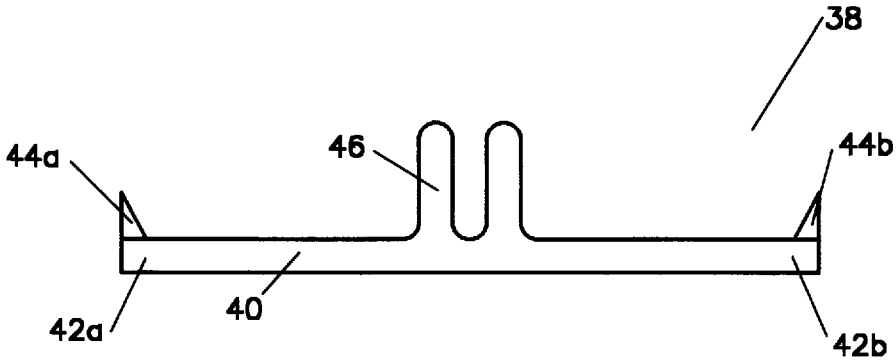
FIG. 8 is a side view of the part in FIG. 7.
Figure 9:
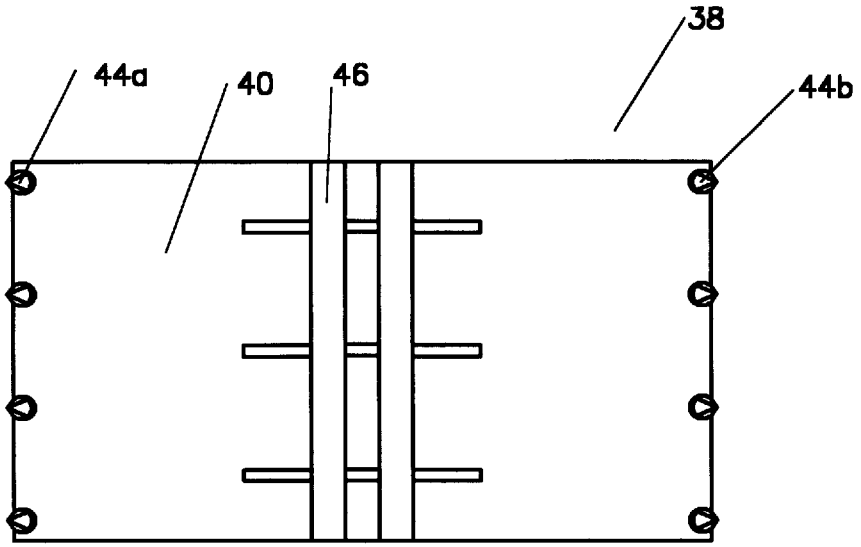
FIG. 9 is a top view of the part in FIG. 7.
Figure 10:
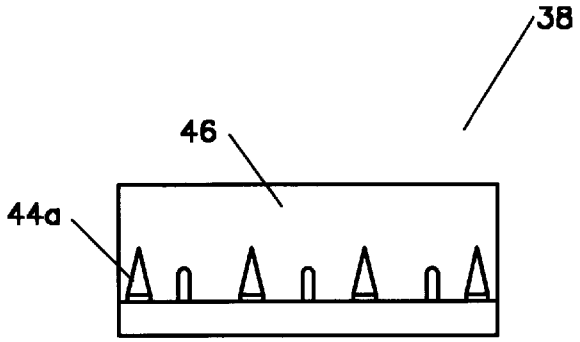
FIG. 10 is an end view of the part in FIG. 7.

A relatively rigid plastic plate 38 which is best seen in FIGS. 7–10 is immovably partially disposed in the second member 26 during the molding process. The plate 38 is preferably made of a core polycarbonate material, but other rigid materials may be employed to accomplish the purposes described herein. The plate 38 has a base 40 which has a configuration of a length, width and height slightly less that the second member 26 to be disposed there within and lend substantial rigidity throughout the same. The plate 38 has ends 42*a* and 42*b* which have a plurality of integrally formed retention protrusions (spikes) 44*a* and 44*b,* respectively. An intermediate structural portion 46 is provided and which lends structural strength and is useful in the molding process. The retention protrusions 44*a* and 44*b* extend through the top surfaces 32*a* and 32*b,* once the molding process has been complete. The retention protrusions 44*a* and 44*b* respectively removably seat in the retention open surfaces 24*a* and 24*b.*

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A sanding block for hand held use, which includes:

a first member having an intermediate portion and a pair of relatively flexible ends wherein a top surface of said first member is configured to be hand held and a bottom surface of each of said ends has at least one retention open surface therein; and a second relatively rigid member having an intermediate portion connected to said intermediate portion of said first member and a pair of ends wherein a top surface of each said end of said second member has extending therefrom at least one complimentary retention protrusion which respectively seat in one of said retention open surfaces and wherein said ends of one of said first member and said second member have a chamfered edge extending along a periphery thereof.

2. The sanding block of claim 1, which is further characterized as having said chamfered edge extending about said top surface of each end of said second member.

3. The sanding block of claim 1, wherein said top surface of said first member has a plurality of relatively flexible treads formed thereon.

4. The sanding block of claim 1, wherein said second member has a bottom surface having a plurality of relatively nonflexible treads formed on the surface thereof.

5. The sanding block of claim 1, wherein said retention protrusions are part of relatively rigid plastic plate partially immovably disposed within said second member.

6. A sanding block for hand held use, comprising:

a first member having an intermediate portion and a pair of relatively flexible ends wherein a top surface of said first member is configured to be hand held and a bottom surface of each of the ends has at least one retention open surface therein;

a second member having an intermediate portion connected to the intermediate portion of the first member and a pair of ends; and a third relatively rigid member immovably partially disposed within said second member and having at least one retention protrusion outwardly extending from a top surface of each end of the second member which respectively seat in one of said retention open surfaces.

7. The sanding block of claim 6, wherein said ends of one of said first member and said second member have a chamfered edge extending about a periphery thereof.

8. The sanding block of claim 7, which is further characterized as having said chamfered edge extending along said top surface of each end of said second member.

9. The sanding block of claim 6, wherein said top surface of said first member has a plurality of relatively flexible treads formed thereon.

10. The sanding block of claim 6, wherein said second member has a bottom surface having a plurality of relatively nonflexible treads formed on the surface thereof.

* * * * *